United States Patent [19]

Plumadore

[11] 4,088,892

[45] May 9, 1978

[54] CORONA CHARGING APPARATUS AND METHOD

[75] Inventor: John D. Plumadore, Westfield, Mass.

[73] Assignee: Scott Paper Company, Philadelphia, Pa.

[21] Appl. No.: 731,210

[22] Filed: Oct. 12, 1976

[51] Int. Cl.[2] ..... H01T 19/04

[52] U.S. Cl. ..... 250/325

[58] Field of Search ..... 250/325

[56] References Cited

U.S. PATENT DOCUMENTS

| | | | |
|---|---|---|---|
| 2,777,957 | 1/1957 | Walkup | 250/325 |
| 2,778,946 | 1/1957 | Mayo | 250/325 |
| 2,856,533 | 10/1958 | Rosenthal | 250/325 |
| 2,890,343 | 6/1959 | Botton | 250/325 |
| 3,527,941 | 9/1970 | Culhane et al. | 250/325 |

*Primary Examiner*—Harold A. Dixon

*Attorney, Agent, or Firm*—R. Duke Vickrey; John W. Kane, Jr.; William J. Foley

[57] ABSTRACT

Disclosed are apparatus and method for electrostatically charging a moving electrophotographic film to a predetermined charge potential over wide variations in film movement speed. The apparatus comprises a corona discharge electrode, high voltage potential means for producing corona current flowing from the corona discharge electrode to the film, an electrically conductive control electrode extending parallel to and across the width of the film at a position less than ¼ inch from the film and in the direction of film movement from the corona discharge electrode, and biasing means for biasing the control electrode at a potential proportional to the film predetermined charge potential for limiting the charge on the film to the predetermined charge potential.

15 Claims, 1 Drawing Figure

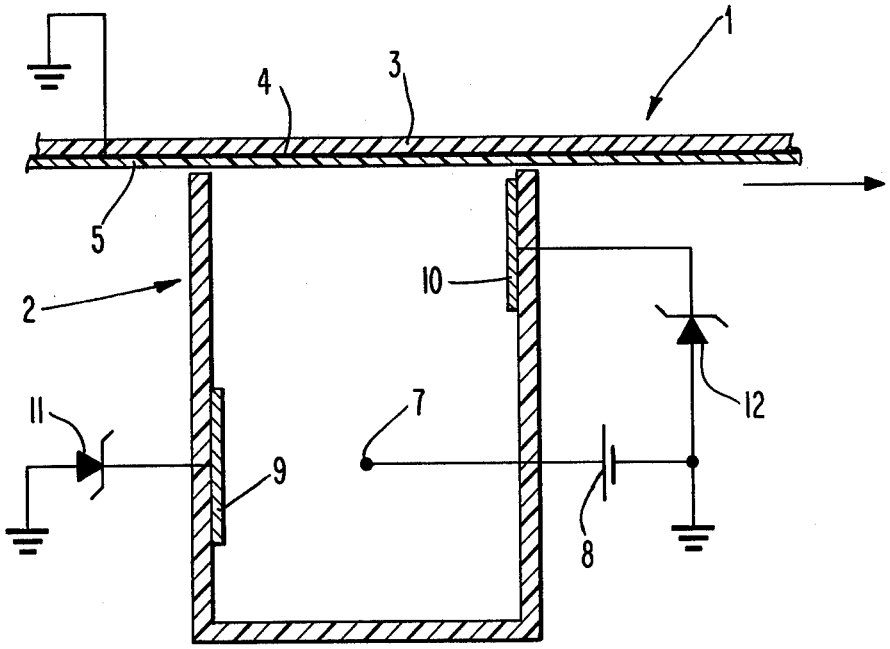
1
3
4
5
2
10
12
11
7
9
8

CORONA CHARGING APPARATUS AND METHOD

The Government has rights in this invention pursuant to Contract Number F33615-76-C-1312, awarded by the United States Air Force AFSC Aeronautical Systems Division.

BACKGROUND OF THE INVENTION

1. Field of the Invention

The invention relates to the field of electrophotography and more particularly to a method and apparatus for applying an electrostatic charge to a moving electrophotographic film.

2. Description of the Prior Art

In electrophotography, it is common to apply a uniform electrostatic charge to the surface of a photoconductive layer. The charge in selected areas is then dissipated in a pattern by exposing the surface to a light image to form an electrostatic latent image. The latent image is then rendered visible by applying thereto finely divided electrostatically charged developer particles which adhere to the surface by electrostatic attraction. Permanent visible images can be obtained, for example, by using thermoplastic developer particles which are heat fused to the photoconductive layer.

Charging is conventionally accomplished by exposing the surface of the photoconductive layer to a corona source, the polarity of which is chosen to produce the desired results upon the particular photoconductive layer being charged. The corona source is commonly provided by one or more fine wires positioned close to the photoconductive layer. When a high voltage potential is applied to the wire or wires, a corona is generated or discharged and ions are attracted to and deposited on the surface of the photoconductive layer. Superior image reproductions are obtainable only when very uniform electrostatic charges are established on the photoconductive layer before imaging.

High voltages for generating corona are particularly desirable for producing charge uniformity, but can subject the photoconductive layer of the film to excessive charge build-up (charge potential), which can damage the photoconductive layer by current leakage into the conductive layer beneath. A number of techniques have been employed to limit the charge potential on the photoconductive layer. For example, complex electrical circuitry has been used to limit corona production (an example being disclosed in U.S. Pat. No. 3,335,275 to King).

A number of problems which are easily solved when charging a moving film when the apparatus is designed to move the film at only one speed are more difficult to solve when the film speed is varied. For example, if the film is moved too slowly, it tends to overcharge, resulting in voltage leaking through the photoconductive layer and damaging the film. On the other hand, if the film is moved too rapidly past the charging apparatus, insufficient charging results. Varying charge rate could be compensated for by varying the corona voltage, but complex electronic circuitry would be necessary. Additionally, the rate and degree of charging is affected by other factors, such as humidity, which changes as the apparatus warms up.

Another technique employed to limit the charge potential on a film is the use of a wire grid or screen placed between the corona discharge wire and the photoconductive surface. This apparatus is commonly referred to as a "scorotron" and is described in U.S. Pat. No. 2,777,957. The grid is maintained at a predetermined potential and serves to terminate further charging of the photoconductive surface when the charge on all portions of the photoconductive surface corresponds to the grid potential. The grid can be grounded or biased by means of an external voltage source, or it can be self-biased from the corona current by connecting the grid to ground through current flow restricting devices (an example of the latter being illustrated in U.S. Pat. No. 3,729,649).

Using a "scorotron", a high voltage can be applied to the corona discharge wire without fear of overcharging the photoconductive surface. One disadvantage of the "scorotron" grid is the "shadowing" effect which is particularly noticeable when charging a moving recording element and a portion of the grid extends in the direction parallel to the direction of relative movement. Another disadvantage to the "scorotron" is its complexity and cost of manufacture, due to the necessity of providing delicate and uniformly sized members, particularly when using it in small charging systems. It is also difficult to repair and clean and is inefficient in operation because it drains a large amount of corona current away from the film. The "scorotron" is useful for controlling the charge potential on a moving film but it has disadvantages. In addition to those already listed, it encourages arcing between the grid and the portion of the film just moving into the charging or corona zone, since the grid is very close to the film and has a relatively high potential difference between it and the portion of the film entering the corona zone.

SUMMARY OF THE INVENTION

In view of the shortcomings of the prior art, it is an object of the present invention to provide a method and apparatus for charging a moving electrophotographic film with a simple, efficient apparatus capable of charging the film to a desired charge potential over a wide range of speed variation.

The invention is an apparatus for charging a moving electrophotographic film to a predetermined charge potential, comprising: a corona discharge electrode spaced from the film and extending parallel to and across the width of the film; high voltage potential means connected to the corona discharge electrode for producing corona current; an electrically conductive control electrode extending parallel to and across the width of the film at a position which is less than ¼ inch from the film and in the direction of film movement from the corona discharge electrode; and biasing means for biasing the control electrode at a potential proportional to the film predetermined charge potential, thereby limiting the maximum charge on the film to the predetermined charge potential.

The invention is also a method for applying a uniform electrostatic charge to an electrophotographic film moving past a corona discharge electrode to produce a predetermined charge potential on the film, comprising the steps of: providing corona current flowing in a corona zone from the corona discharge electrode to the film; moving the film through the corona zone whereby charge builds up on the film; and progressively directing a greater amount of the corona current away from the film towards the position where the film exits from the corona zone as the film moves through the corona zone.

Preferred embodiments of the invention are described below.

BRIEF DESCRIPTION OF THE DRAWINGS

The drawing is a schematic cut-away end view of the preferred apparatus of the invention illustrated in position to charge a moving electrophotographic film.

DESCRIPTION OF THE PREFERRED EMBODIMENTS

The apparatus of the invention in its preferred form is illustrated in the drawing, where an electrophotographic film 1 is transported past a corona charging module 2 in the direction of the arrow. The means for moving the film (not shown) can be provided by any conventional means, such as driven rollers. In the preferred form of the invention, the film 1 is moved past the charging module 2, but the invention would work just as well if the charging module 2 were moved past a stationary film, in which case the charging module would move in a direction opposite to the arrow indicated in the drawing. Therefore, the term "moving film" is intended to mean relative movement between the film and the charging apparatus.

The electrophotographic film 1 is of conventional design and is illustrated as a support 3 coated with a very thin conductive layer 4, which is in turn coated with a photoconductive layer 5. The support 3 is preferably of electrically insulating material and may comprise any of the well known materials used for such purposes. Any conventional conductive materials may be employed to render the conductive layer 4 electrically conductive, such as plated metallic or other conductive layer coated onto support 3. Similarly, any conventional photoconductive material may be used to form a photoconductive layer 5. The invention is useful for charging any dielectric surface, although it is particularly designed for electrophotographic members. The term "film" is used in the specification and claims for convenience, and is meant to include any member having a dielectric surface capable of being charged from a corona source.

The film 1 is preferably grounded through a connection to the conductive layer 4. Grounding may be accomplished by any of a number of well known techniques, such as removing a portion of the photoconductive layer 5 or the insulating support 3 to permit the ground connection to contact the conductive layer 4. In the preferred use of the invention, the film is in roll form and is unwound from a metallic reel. A satisfactory ground connection can be made at the end of the film to the reel, and a ground connection made to the reel.

Charging module 2 is preferably made from electrically insulating material, such as plastic, and extends across the full width of the film 1 (transverse to the direction of film movement). The module 2 is generally closed except for the opening at the top which permits corona current to flow from module 2 to that portion of the film 1 passing over the opening. Thus, the opening forms the corona zone where charging of the film 1 takes place. It should be noted here that the opening does not have to be at the top of module 2, but can be at any position across which the film moves.

Mounted within charging module 2 is a corona discharge electrode 7 extending across the width of film 1 and parallel to the film. Corona discharge electrode 7 is preferably provided by a fine metallic wire of conventional design and is spaced from the opening of the module a sufficient distance to provide a generally uniform corona current field at the film in a manner well known in the art. The wire is electrically connected to high voltage potential source 8, which can be provided by a conventional power supply, preferably D.C., and typically provides a potential in the range of from 3,000 to 10,000 volts.

To one side of corona discharge electrode 7 is a corona initiating electrode 9 positioned within charging module 2 relatively close to corona discharge electrode 7. Corona initiating electrode 9 is preferably constructed from a thin strip of electrically conductive material coextensive with and parallel to corona discharge electrode 7. The function of corona initiating electrode 9 is to enable initiation of corona at a lower voltage by providing a large potential drop over a short distance and to draw sufficient corona current during operation to stabilize the corona. Corona initiation electrode 9 is connected to ground through a zener diode 11, which resists the flow of current from corona initiating electrode 9 until a predetermined potential level is reached. After the predetermined potential level is reached, current flows to ground with little restriction, preventing further potential build up on corona initiating electrode 9. The predetermined potential level is chosen to be sufficiently high to avoid arcing between corona initiation electrode and corona discharge electrode.

In operation, corona current flows in a corona zone to the electrophotographic film 1. The corona zone is defined by the opening in corona module 2, since the insulating surface of the corona module confines the corona current within the module. As film 1 moves through the corona zone, charges are deposited upon the photoconductive layer 5 of film 1, and the charge potential gradually increases on a given portion of the film 1 moving through the corona zone. If film 1 moves slow enough, the charge potential on the film will approach the same potential level as that of the corona source. Usually, this level is so high that film 1 would be damaged by discharge through the photoconductive layer 5. If the film 1 moves fast enough through the corona zone, the charge potential level which builds up on the film 1 can be kept to a value much less than that of the corona source, but will vary if the film speed varies and may not be at the desired level. In operations where the speed of the film 1 moving through the apparatus is varied to satsify imaging requirements, controlling the charge potential produced on the film would be difficult except for use of control electrode 10, which is described below.

Good flexibility in varying the speed of film 1 past corona module 2 is provided by the present invention, which features control electrode 10. Control electrode 10 is preferably provided by a thin electrically conductive strip of material extending parallel to and across the width of the film at a position very close to the opening of module 2 and on the wall of the module 2 where the film exits from the corona zone. It is electrically connected to biasing means, which is preferably provided by a zener diode 12, for limiting the current flowing from the control electrode 10 and thereby maintaining a predetermined voltage on the control electrode 10. The zener diode restricts current flow below a predetermined voltage level, and permits almost unrestricted current flow above that level. The predetermined voltage is chosen to be proportional to the charge potential desired on the film. "Proportional" means that the charge potential on the control electrode corresponds to the charge potential on the film when considering relative geometric positions of the two within the charge field. Thus, if the electrode were at the same position as the film, it would have the same charge potential, but if away from the film, it would be somewhat different. The proportional relationship is empirically determined after the exact position of the control electrode is chosen, and the potential to be maintained on the control electrode to obtain a given desired charge potential on the film can then be easily determined.

In operation, corona current flows to both the photoconductive surface 5 of the film 1 and to the control electrode 10. The potential level on control electrode 10 builds up quickly and is maintained constant by the biasing means, preferably provided by zener diode 12. In contrast, the charge potential on the photoconductive surface 5 increases from zero on a given portion of the film 1 as it enters the corona zone and gradually builds up as the given portion moves through the corona zone. At the same time, charge build up on the film 1 is progressively more influenced by the attraction of corona current to the control electrode 10 as the given portion of the film 1 moves through the corona zone. This is particularly true as the charge potential on the film 1 approaches the proportional relationship to the charge potential on the control electrode 10, since the corona current will preferentially flow to the member at the lowest potential, or more accurately, the lowest potential after adjusting for relative positions in the charge field. Thus, the charge potential on the film will not build to a level higher than that which is proportional to the potential on the control electrode 10. And this control is not significantly affected by typical speed variations in movement of the film through the apparatus.

To be effective, the control electrode 10 should be positioned as close to the photoconductive layer 5 as practicable. Of course, the obvious film damage may occur if the film 1 is in actual rubbing contact with the control electrode 10. It is therefore, usually desirable to maintain a small gap between the control electrode and the film 1. The control electrode 10 can be spaced farther from the film and still be effective, but its effect diminishes at greater distances from the film. It should be no greater than ¼ inch away from the film, preferably no greater than ⅛ inch away, and even more preferably no greater than 1/16 inch away. When referring to the distance of the control electrode 10 away from the film 1, the measurement is taken to the part of the control electrode 10, closest to the film 1. It should be recognized that the rest of the control electrode 10 may be farther away.

The specific shape of the control electrode 10 can be varied somewhat and still be effective, however, it is particulary desirable that it be a relatively wide strip, such as that illustrated in the drawing. A narrow member, such as a wire, is much less effective in attracting corona current away from the film at distances away from the control electrode. On the other hand, a relatively wide strip, ¼ inch for example, will be effective for about the last ¼ inch of film travel in the corona zone. The "width" of the electrode is the major dimension of the electrode other than the dimension transverse to the film movement direction. In the drawing, the width is the vertical dimension. "Relatively wide" means that it is at least as wide as its spacing from the film, but preferably several times as great, such as four or more. It may be desirable with some designs to extend the "width" of the control electrode 10 in a direction parallel to the film, rather than perpendicular as shown in the drawing.

The present invention is effective in limiting the charge produced on an electrophotographic film to a desired predetermined charge potential while moving the film past the charging apparatus at varying speeds. It has a number of advantages over the grids used in the prior art "scorotrons" in that it is quite simple, inexpensive to manufacture, more efficient in operation, and avoids the aforementioned arcing problem of the "scorotron".

Although the drawing illustrates the preferred embodiment of the invention, a number of variations can be employed and still obtain many of the advantages of the invention. For example, biasing means for the control electrode 10 is illustrated as a zener diode 12, which is preferred, but it should be recognized that it can be replaced with an independent power supply of low impedance which will permit sufficient corona current to flow from the control electrode to function in its intended manner. The zener diode 11 connected to corona initiating electrode 9 could also be replaced by a power supply of low impedance or even by a properly chosen resistor. It should also be noted that both corona initiating electrode 9 and control electrode 10 could be connected to a single common zener diode, but in some cases it is desirable for corona initiating electrode 9 to be maintained at a higher potential than control electrode 10, in which case corona initiating electrode 9 should be connected to a zener diode separate from control electrode 10.

Although it is highly desirable to employ a corona initiating electrode, the invention in its broadest sense centers about the control electrode 10, and in some cases it may be satisfactory to use it alone. It should also be noted that the invention in its broadest sense does not require the corona module 2, although the module 2 is particularly useful for providing a structure to hold the electrodes 7, 9, and 10 and to provide beneficial confinement of the corona current. Even without the corona module 2, corona current would flow in a similar path forming a corona zone, but the corona zone would be less defined, particularly at the entrance, and the operation would be less efficient.

As a further illustration of the invention, the following example of a satisfactory apparatus is described. A corona module was constructed from a block of nylon 1 inch high, ½ inch wide, and 11 inches long. A portion of the block was cut away leaving the block only ¼ inch high except at both ends where portions ½ inch long were left intact. Sides which were 10 inches long and 1 inch high were made from copper clad circuit board material and screwed to the sides of the block leaving a ½ inch × 10 inch opening at the top. The circuit board material was made from 0.060 inch thick fiber glass reinforced epoxy resin board with 0.003 inch thick copper cladding. All of the copper cladding was etched away except a ¼ inch wide × 10 inches long strip at the top of one board and a ¼ inch wide × 10 inches long strip centered at ½ inch from the top of the other. The first mentioned copper strip formed the control electrode, and the other formed the corona initiating electrode. A platinum wire 0.020 inches in diameter and about 9 inches long was mounted in the module ½ inch from the top and ¼ inch from both sides. The positive side of a 7,000 volt D.C. power supply was connected to one end of the wire. The control electrode was connected to ground through a zener diode chosen to pass current at 1000 volts, and the corona initiating electrode was connected to a zener diode chosen to pass current at 1500 volts. Conventional electrophotographic film 9 inches wide was unwound from a reel and moved across the opening of the module almost in contact with the top of the module at speeds varying from 0.01 inches/-sec. to 0.5 inches/sec. The film was kept about 0.020 inches away from the control electrode. In all tests the film charged to a potential of 1200 volts with a variation of only about 30 volts.

What is claimed is:

1. Apparatus for electrostatically charging a moving electrophotographic film to a predetermined charge potential, comprising:

a corona discharge electrode spaced from the film and extending parallel to and across the width of the film;

high voltage potential means connected to the corona discharge electrode for producing corona current;

an electrically conductive control electrode extending parallel to and across the width of the film at a position less than ¼ inch from the film and in the direction of film movement from the corona discharge electrode;

biasing means for electrically biasing the control electrode at a potential proportional to the film predetermined charge potential, thereby limiting the maximum charge on the film to the predetermined charge potential; and an electrically conductive corona initiating electrode extending parallel to and across the width of the film at a position closer to the corona discharge electrode than the control electrode is from the corona discharge electrode.

2. Apparatus according to claim 1, further including current controlling means electrically connected to the corona initiating electrode for controlling the amount of current flowing from the corona initiating electrode to draw sufficient corona current to stabilize the corona discharge and to produce a sufficiently high potential on the corona initiating electrode to avoid arcing from the corona discharge electrode to the corona initiating electrode.

3. Apparatus according to claim 2, wherein the current controlling means is provided by a zener diode.

4. Apparatus according to claim 2, wherein the current controlling means is provided by a resistor.

5. Apparatus for electrostatically charging a moving electrophotographic film to a predetermined charge potential, comprising:

a corona discharge electrode spaced from the film and extending parallel to and across the width of the film;

high voltage potential means connected to the corona discharge electrode for producing corona current flowing to the film in a corona zone;

a control electrode extending parallel to and across the width of the film at a position less than ¼ inch from the film and at the boundary of the corona zone where the film exits, the control electrode being provided by a relatively wide strip of electrically conductive material with the wide dimension extending perpendicular to the film; and biasing means for electrically biasing the control electrode at a potential proportional to the film predetermined charge potential, thereby limiting the maximum charge on the film to the predetermined charge potential.

6. Apparatus according to claim 5, wherein the biasing means is provided by current restricting means electrically connected to the control electrode for limiting the current flowing from the control electrode and thereby maintaining the potential on the control electrode proportional to the film predetermined charge potential.

7. Apparatus according to claim 6, wherein the current restricting means is provided by a zener diode.

8. Apparatus according to claim 5, wherein the control electrode is at a position less than ⅛ inch from the film.

9. Apparatus according to claim 8, wherein the control electrode is at a position less than 1/16 inch from the film.

10. Apparatus according to claim 5, wherein the width of the control electrode is approximately 174 inch.

11. Apparatus according to claim 5, wherein the high voltage potential means is provided by a D. C. power source.

12. Apparatus according to claim 5, wherein the corona discharge electrode and the control electrode are mounted within a corona module which is made of an electrically insulating material and is generally closed except for an opening across which the film is moved to form a corona zone.

13. Apparatus for electrostatically charging a moving electrophotographic film to a desired predetermined charge potential, comprising:

a corona module of electrically insulating material which is generally closed on all sides except for an opening across which the film is moved, the opening forming a corona zone;

a corona discharge electrode mounted within the corona module parallel to and across the width of the film and spaced from the opening of the corona module;

a high voltage D. C. potential source connected to the corona discharge electrode for producing corona current flowing to the corona zone;

a control electrode extending parallel to and across the width of the film at a position less than 1/16 inch from the opening and at the boundary of the corona zone where the film exits, the control electrode being provided by a relatively wide strip of electrically conductive material with the wide dimension extending into the module away from the opening;

a zener diode connected to the control electrode for maintaining the potential on the control electrode at a predetermined level proportional to the predetermined charge potential desired on the film;

an electrically conductive corona initiating electrode extending parallel to and across the width of the film at a position closer to the corona discharge electrode than the control electrode is from the corona discharge electrode; and current controlling means electrically connected to the corona initiating electrode for controlling the amount of current flowing from the corona initiating electrode to draw sufficient corona current to stabilize the corona discharge and to produce a sufficiently high potential on the corona initiating electrode to avoid arcing from the corona discharge electrode to the corona initiating electrode.

14. Method of applying a uniform electrostatic charge to an electrophotographic film moving past a corona discharge electrode to produce a predetermined charge potential on the film, comprising the steps of:

providing corona current flowing in a corona zone from the corona discharge electrode to the film;

moving the film through the corona zone whereby charge builds up on the film; and progressively directing a greater amount of the corona current away from the film towards the position where the film exits from the corona zone as the film moves through the corona zone.

15. Method according to claim 14, wherein the corona current directed away from the film is attracted to a control electrode which is positioned at the boundary of the corona zone where the film exits and is maintained at a charge potential proportional to the predetermined charge potential of the film so that the control electrode limits the maximum charge potential on the film to the predetermined charge potential and is progressively more effective as the film moves through the corona zone.

* * * * *

UNITED STATES PATENT OFFICE

CERTIFICATE OF CORRECTION

Patent No. 4,088,892 Dated May 9, 1978

Inventor(s) John D. Plumadore

It is certified that error appears in the above-identified patent and that said Letters Patent are hereby corrected as shown below:

Column 8, line 20, change "174" to --1/4--.

Column 9, line 3, change "of" to --for--.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*